US005349841A

United States Patent [19]

Honma et al.

[11] Patent Number: 5,349,841

[45] Date of Patent: Sep. 27, 1994

[54] FEEDING APPARATUS FOR METAL BELTING AND MANUFACTURING APPARATUS FOR FINS OF A HEAT EXCHANGER

[75] Inventors: Kensaku Honma; Masahide Sakaguchi; Toshiki Miyazawa, all of Tokyo, Japan

[73] Assignee: Hidaka Seiki Kabushiki Kaisha, Tokyo, Japan

[21] Appl. No.: 988,796

[22] Filed: Dec. 10, 1992

[30] Foreign Application Priority Data

Dec. 17, 1991 [JP] Japan ..... 3-353294

[51] Int. Cl.[5] ..... B21D 28/00; B21D 43/12

[52] U.S. Cl. ..... 72/333; 72/337; 72/339; 72/404; 29/726; 226/75

[58] Field of Search ..... 72/404, 422, 333, 329, 72/337, 339; 29/726, 727; 226/75, 74, 170, 173

[56] References Cited

U.S. PATENT DOCUMENTS 2,730,358 1/1956 Riordan ..... 226/75
4,601,421 7/1986 Natterer ..... 226/75

FOREIGN PATENT DOCUMENTS 1203993 10/1965 Fed. Rep. of Germany ..... 226/75
135738 8/1983 Japan ..... 29/726
194960 11/1984 Japan ..... 226/74
1-166823 3/1989 Japan .

*Primary Examiner*—Daniel C. Crane

[57] ABSTRACT

A feeding apparatus for a metal belting has a basic plate being capable of supporting the metal belting, which has a plurality of through-holes in a feeding direction. The basic plate has slit formed in the feeding direction and a plurality of traveling plates are provided beneath and in parallel to the basic plate. The traveling plates are movable in the feeding direction of the metal belting. A driving mechanism for moving the traveling plates in the feeding direction of the metal belting is provided as well as a plurality of feeding pins which are vertically pierced through the traveling plates. Springs bias the feeding pins downward. A plate cam is provided beneath the traveling plates. The plate cam is capable of applying force to upwardly move the feeding pins, against the springs, in a prescribed range.

20 Claims, 10 Drawing Sheets

FEEDING APPARATUS FOR METAL BELTING AND MANUFACTURING APPARATUS FOR FINS OF A HEAT EXCHANGER

BACKGROUND OF THE INVENTION

The present invention relates to a feeding apparatus for a metal belting and a manufacturing apparatus for fins of a heat exchanger, and more precisely relates to a feeding apparatus for a metal belting having a plurality of through-holes, which are provided in a feeding direction of the metal belting with prescribed intervals, and a manufacturing apparatus for Fins of a heat exchanger having said feeding apparatus.

Fins of a heat exchanger, such as an air conditioner, are shown in FIG. 12. Collared through-holes 104 are formed in ia longitudinal direction of a thin metal plate ].02, which is made of aluminum, etc.. Each collared through-hole 104 has, as clearly shown in FIG. 12B, a through-hole section 106 and a collar section 108 having a flange section. Heat tubes are pierced through the collared through-holes 104 so as to enlarge heat conductive area, so that heat conductivity of the heat exchanger can be raised.

Furthermore, to raise heat conductivity, there are formed louvers 112 between the collared through-holes 104. The louvers 112 are, as clearly shown in FIG. 12C, formed by bending narrow stripe sections, which are formed by slitting a metal belting, upward and downward.

The fin 100 also has corner-cut sections 110 so as to avoid interference with members, which are provided close to the fin 100.

The fin 100 is normally made of a wide metal belting 120 shown in FIG. 13. A plurality of fins 100 are simultaneously formed.

The steps of making the fins 100 are:

forming the louvers 112 on the metal belting 120 (Step-L);

barring to bore small holes for the collared through-holes 104 (Step-B);

ironing the small holes to form the hole sections 106 and the collar sections 108 (Step-A); and bending front ends of the collar sections 108 to form flange sections (Step-F).

By the above described steps, a plurality of lines of the collared through-holes 104 and the louvers 112 are formed mutually parallel in the longitudinal direction of the metal belting 120.

After the Step-F, there are further steps of:

forming cut sections 122, which will be formed into the corner-cut sections 110 (see FIG. 12), etc., between the lines of the through-holes 104 (Step-N);

slitting the metal belting 120 alongside each line of the through-holes 104 to make slit plates 124 (Step-S); and cutting the slit plates 124 to prescribed length (Step-C).

During the sequential steps, it is difficult to push the thin metal belting 120 for feeding them for said steps shown in FIG. 13. Therefore, a feeding apparatus for feeding the slit plates 124 from Step-S to Step-C is normally used.

A conventional feeding apparatus is shown in FIGS. 11A and 11B. A reciprocal traveler 160 can be reciprocatively moved right and left by driving means (not shown). A pin 180 is provided in the reciprocal traveler 160 and always biased upward by a spring 200. A part of an upper end of the pin is formed into a slope. A part of the upper end of the pin 180 is projected from an upper face of the reciprocal traveler 160 and an upper face of a basic plate, on which the slit plate 124 having the collared through-holes 104 is supported. The pin 180 is capable of integrally moving with the reciprocal traveler 160.

In FIG. 11A, if the reciprocal traveler 160 moves in the direction of an arrow E, the part of the upper end of the pin 180, which is projected from the upper face of the basic plate, fits into the collared through-hole 104, which is on the basic plate and corresponds to a slit 140 thereof, and comes into contact with an inner face of the collared through-hole 104, so that the pin 180 is capable of pushing the collared through-hole 14 in the direction of an arrow D. By pushing the collared through-hole 14, the slit plate 124 can be moved together with the reciprocal traveler 160.

On the other hand, in FIG. 11B, if the reciprocal traveler 160 moves in the opposite direction, the direction of an arrow G, the slip plate 124 is practically at a standstill. Namely, the pin 180 moves in the direction G keeping the slope of the upper end in contact with an edge of the collared through-hole 104, and a force against tile spring 200 works on the pin 180. By the force working on the pin 180, the pin 180 is gradually pushed into the reciprocal traveler 160 and the projected height thereof becomes lower, so that the pin 180 comes out from the collared through-hole 104 The upper end of the pin 180, which has come out, slides on the bottom face of the slit plate 124 and fits into the next collared through-hole 104 without substantially applying force to the slit plate 124.

In the feeding apparatus of FIGS. 11A and 11B, the slit plate 124 can be fed in the direction D. Therefore, if the pin 180 is provided for every slit plate 124, the metal belting 102 (see FIG. 13) also can be fed in the direction D.

However, in the conventional feeding apparatus, the metal belting 102 is fed intermittently. If a rotary disk cutter, which is capable of continuously slitting the metal belting 102, is used in said Step-S as a slitter, it is difficult to show full performance of the slitter.

If the slit plate 124 is cut to a prescribed length by a cutter in said Step-C, it is necessary to stop the movement of the feeding pins to locate the slit plate 124. But the slope of the upper end of the pin 180 (see FIGS. 11A and fits into the collared through-hole 104, so it is impossible to locate the slit plate 124 by the pin 180 only, and locating means is required. Therefore, a machining apparatus for the following steps, which includes a slitter and a cutter, must be complex in structure.

In the Japanese Patent Kokai Gazette No. 1-166823, a manufacturing apparatus for fins of a heat exchanger is disclosed. The manufacturing apparatus comprises a press machine having a die set for said Step-A and Step-F, and machining apparatus including an intermediate die set for said Step-N, a slitter for said Step-S and a cutter for said The press machine and the machining apparatus are mutually separated. If the slitter and the cutter are provided close to the intermediate die set, it is necessary to accurately locate the collared through-holes 104 so as to avoid an interference between the collared through-holes 104 and the intermediate die set. Therefore, the machining apparatus including the intermediate die set, the slitter and the cutter must be as large as the press machine having the die set for said Step-A. Namely, the machining apparatus must be large.

SUMMARY OF THE INVENTION

An object of the present invention is to provide a feeding apparatus, which is capable of continuously feeding a metal belting without transforming collared through-holes.

Another object is to provide a manufacturing apparatus for fins of a heat exchanger, which is capable of making a machining apparatus compact.

The objects can be achieved by applying a feeding apparatus having a mechanism, which is capable of fitting feeding pins into through-holes without contact with a bottom face of a metal belting or a slit plate and coming out therefrom after moving to a prescribed length.

Namely, in the present invention, a feeding apparatus :for a metal belting comprises:

a basic plate being capable of supporting the metal belting, which has a plurality of through-holes in a feeding direction, the basic plate having a slit formed in the feeding direction, wherein the through-holes correspond to the slit when the metal belting is supported on the basic plate;

a plurality of traveling plates being provided beneath and in parallel to the basic plate, the traveling plates being capable of moving in the feeding direction of the metal belting;

driving means for moving the traveling plates in the feeding direction of the metal belting;

a plurality of feeding pins being vertically pierced through the traveling plates, wherein lower ends of the feeding pins are projected from bottom faces of the traveling plates;

biasing means for biasing the feeding pins downward; and a plate cam being provided beneath the traveling plates, the plate cam being capable of applying force to upwardly move the feeding pins, against the biasing means, in a prescribed range, whereby upper ends of the feeding pins are capable of fitting into the through-holes of the metal belting and moving the metal belting to a prescribed length.

Furthermore, a manufacturing apparatus for fins of a heat exchanger of the present invention comprises:

a die set for forming a plurality of parallel lines of collared through-holes, each of which is formed in a longitudinal direction of a metal belting, in the transverse direction thereof;

a slitter for continuously slitting between adjacent lines of the collared through-holes in the longitudinal direction of the metal belting so as to make slit plates, which includes a line of the collared through-holes;

a cutter for cutting the slit plates to a prescribed length; and a feeding apparatus having:

a plurality of feeding pins being provided between the slitter and the cutter, the feeding pins being capable of moving in the feeding direction of the slit plates and fitting one ends into the collared through-holes of each slit plate;

a plurality of biasing means being provided for each feeding pin, the biasing means biasing the feeding pins to separate away from the collared through-holes;

a plate cam having a cam face, which is extending the feeding direction of the slit plates, for biasing the feeding pins against the biasing means, whereby the feeding pins, which are fitted into the collared through-holes, are capable of moving toward the cutter to a prescribed length; and driving means for moving the feeding pins.

In the feeding apparatus of the present invention, a plurality of traveling plates having feeding pins moves in the feeding direction of the metal belting in order, so that the metal belting can be fed continuously.

Additionally, the feeding pins are capable of moving in parallel to the basic plate and moving up and down, so that the upper end of the feeding pins are capable of fitting into through-holes without contact with a bottom face of the metal belting and coming out therefrom. With this structure, transforming the through-holes and/or the slits, etc., which are formed between the through-holes, caused by the feeding pins can be prevented.

On the other hand, in the manufacturing apparatus for fins of a heat exchanger, feeding of the metal belting and the slit plates are executed by the feeding pins, which have fitted into the collared through-holes. Locating the metal belting and the slit plates is executed by stopping the movement of the feeding pins. With this structure, no means for locating the through-holes and the slit plates is required so that a machining apparatus including the slitter and the cutter can be smaller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Embodiments of the present invention will now be described by way of examples and with reference to the accompanying drawings which are given by way of illustration only, and thus are not limitative of the present invention, and in which.

DETAILED DESCRIPTION OF PREFERRED EMBODIMENTS

Preferred embodiments of the present invention will now be described in detail with reference to accompanying drawings.

Figure 1:
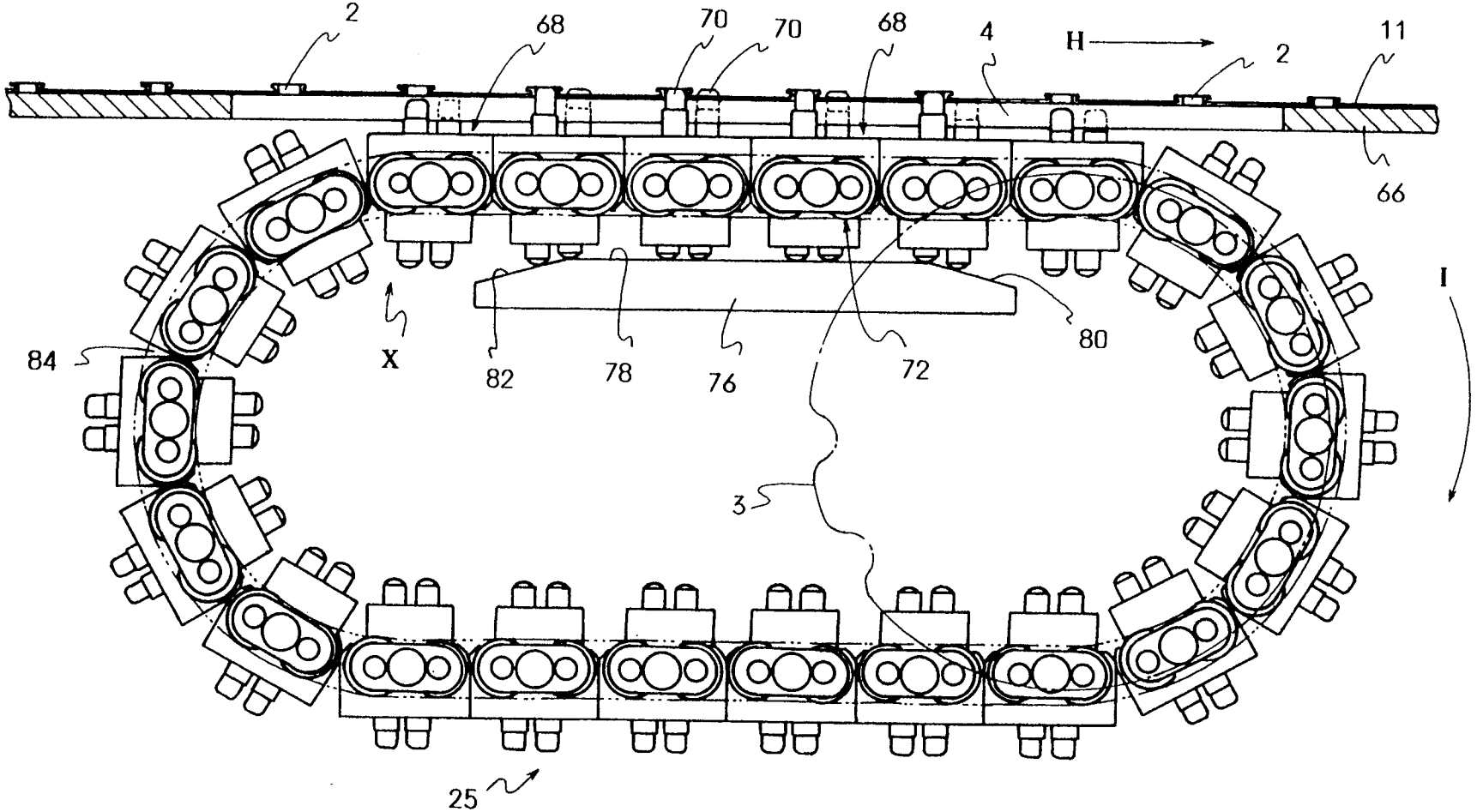
FIG. 1 is an explanation view of an embodiment of a feeding apparatus.

FIG. 1 is an explanation view showing an embodiment of a feeding apparatus of the present invention.

In FIG. 1, the feeding apparatus 25 has a basic plate 66 on which slit plates 11, which are formed by slitting a metal belting to have a prescribed length, are supported. In each slit plate 11, a line of collared through-holes 2 are formed in the feeding direction of the slit plate 11 (the direction H). The basic plate 66 has slits 4, which are formed in the feeding direction of the slit plates 11 and opened immediately under each line of the through-holes 2.

A plurality of traveling plates 68 are provided beneath the basic plate 66. The traveling plates 68 are guided by a looped guide groove 84 (shown by one-dot chain lines)to move in the direction I. The guide groove 84 is formed on a guide plate 45 (not shown in FIG. 1, see FIG. 3), which provided on a side face of the basic plate 66 and in parallel to the feeding direction of the slit plates 11. The traveling plates 68 are driven by a drive mechanism including a drive wheel 3, which is rotated by, for example, a servo motor and is capable of engaging with shafts 85 (see FIGS. 2 and 3) Therefore, the traveling plates 68, which are immediately under the basic plate 66, can be moved in the direction H in parallel to the basic plate 66.

There are provided a plurality of feeding pins 70 to the basic plate 66. The feeding pins 70 are vertically pierced through the traveling plates 68. Lower ends of the feeding pins 70 are projected from bottom faces of the traveling plates 68. The feeding pins 70 are always biased downward by biasing means, e.g. springs.

There is provided a plate cam 76, whose longitudinal sectional shape is a trapezoid, beneath the traveling plates 68, which are moving in the direction H. The plate cam 76 has slope sections 80 and 82 at each end. A horizontal section 78, which is between the slope sections 80 and 82, is capable pushing the lower ends of the feeding pins 70, which are projected from the bottom faces thereof, upward, so that the upper ends of the feeding pins 70 are fitted into the through-holes 2 of the slit plates 11, which correspond to the slits 4 of the basic plate 66, and the slit plates 11 can be moved to a prescribed length.

Figure 2:
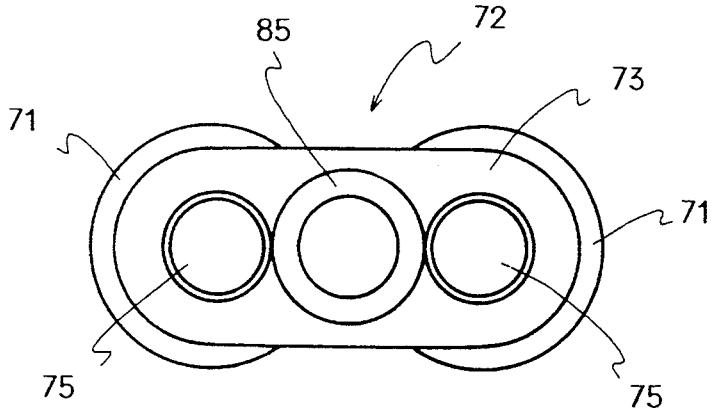
FIG. 2 is a front view of a guide section showing traveling plates shown in FIG. 1.

There is provided a guide section 72 (see FIG. 2) to each traveling plate 68, on the guide groove 84 side, so as to guide the traveling plates 68 to move along the inner face of the guide groove 84. As shown in FIG. 2, each guide section 72 has a link bracket 73, a couple of guide rollers 71, which are rotatably connected to the link bracket 73, and the shaft 85, which is projected from the link bracket 73 and is capable of engaging with the drive wheel 3 so as to transmit driving force to the traveling plates 68.

Figure 3:
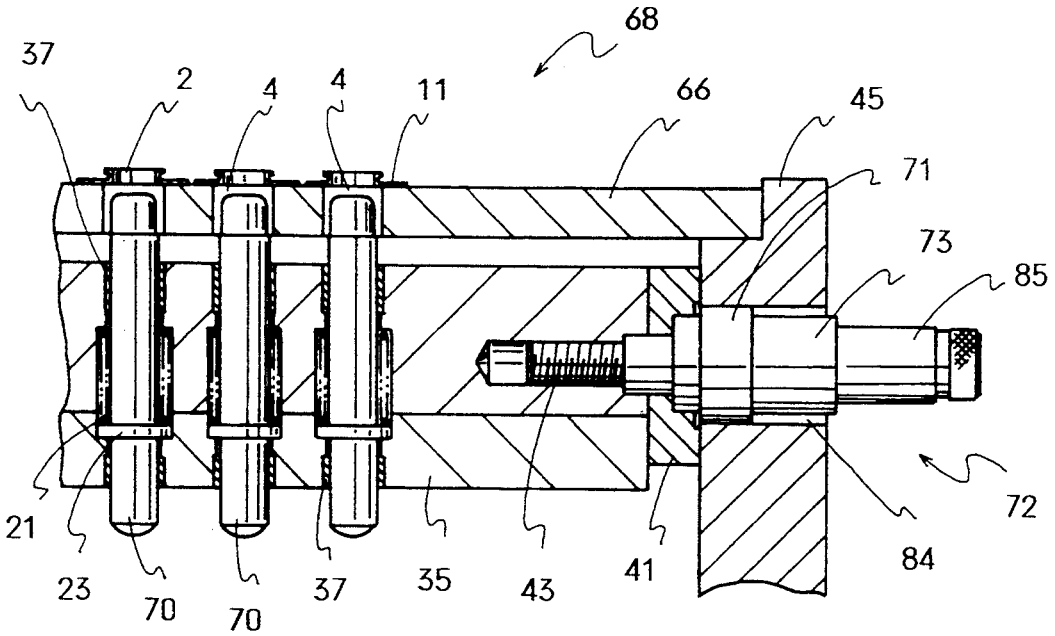
FIG. 3 is a partial sectional view showing the structure of the guide section and the traveling plates.

A sectional view of the traveling plate 68 having the guide section 72 is shown in FIG. 3. The traveling plate 68 shown in FIG. 3 is locating a position X, immediately under the basic plate 66. The guide rollers 71 are rotatably provided to each shaft 75. The shafts 75 have male screw sections 43 and screwed in the traveling plate 68 via a restricting member 41. Note that, the restricting member 41 is provided for adjusting a clearance between the traveling plates 68 and restricting horizontal deviation of the feeding pins 70 to correspond to the upper ends thereof, so that the upper ends of the feeding pins 70 are capable of corresponding to the slits 4 of the basic plate 66.

The guide rollers 71 of the guide sections 72 are capable of rotating in and moving on the inner face of the looped guide groove 84 of the guide plate 45 to guide the traveling plates 68. The guide plate 45 is provided to the basic plate 66, in parallel to the feeding direction of the slit plates 11. Note that, in the present embodiment, the guide plate 45 is supporting the basic plate 66.

The traveling plate 68 is, as shown in FIG. 3, consist of two piled plates 33 and 35. The feeding pins 70 are pierced through the plates 33 and 35, and the upper ends and the lower ends of the feeding pins 70 are projected from the upper and the lower faces of the traveling plate 68. Each feeding pin 70 has a flange section 23. The flange section 23 is always biased downward by a spring 21, which is provided in a space formed in the plates 33 and 35.

Note that, in the present embodiment, as shown in FIG. 3, there are provided guide members 37 at both ends of a through-holes of the traveling plate 68, through which the feeding pins 70 are pierced.

In the feeding apparatus 25 of the present embodiment, the lower ends of the feeding pins of the traveling plate 68, which are at the position X in FIG. 1, can be slid on the slope section 82, the horizontal section 78 and the slope section of the plate cam 76. When the feeding pins 70 slide on the slope section 82, the feeding pins 70 are gradually pushed upward, against the spring 21, so that the upper ends of the feeding pins 70 gradually fit in the through-holes 2 of the slit plates 11.

When the feeding pins 70 slide on the horizontal section 78, the feeding pins 70 continuously fit in the through-holes 2 and moves in the direction H, so that the slit plates 11 can be fed in the direction H. During the feeding pins 70 sliding on the slope section 82 and the horizontal section the feeding pins 70 are gradually pushed upward, against the spring 21.

When the feeding pins 70 slide on the slope section the force to upwardly push the feeding pins 70 is gradually reduced, so that the upper ends of the feeding pins 70 are gradually removed from the through-holes 2 of the slit plates 11 by the elastic force of the spring 21.

In the feeding apparatus 25 of the present embodiment, the feeding pins 70 fit in the through-holes 2 of the slit plates 11 in order and move in the direction H, the slit plates 11 can be fed in the direction H. Note that, before the slit plates 11 are cut off, the metal belting 10 is fed: in the direction H.

When the traveling plates 68 pass the plate cam 76, the traveling plates 68 moves in the direction I alongside the guide groove 84. At that time, the shafts 85 of the traveling plates 68 are engaged with the drive wheel 3 and the driving force of the drive wheel 3 is transmitted to the traveling plates 68. In the present embodiment, a plurality of the traveling plates 68 are adjacent one another, so that the driving force transmitted to one traveling plate 66 is transmitted to other traveling plates 68, and all traveling plates 68 can be moved alongside the guide groove 84.

When the upper ends of the feeding pins 70 fit in the through-holes 2 of the slit: plates 11, if a clearance between the feeding pin 70 and the through-hole 2 is smaller, transformation of the through-hole 2 caused by the feeding pin 70 can be smaller. In case that the clearance is too small, even if the feeding pin 70 leaves the horizontal section 78, the feeding pin 70 is sometimes still caught in the through-hole 2, so that continuous feeding of the slit plates 11 must be stopped.

To avoid catching of the feeding pins 70 in the through-holes 2, there is provided drawing means for drawing the feeding pins 70 out from the through-hole 2 at an end, in the feeding direction of the slit plates 11, of the plate cam 76, so that the slit plates 11 can be fed continuously. An example of the drawing means is, for example, shown in FIG. 4.

Figure 4:
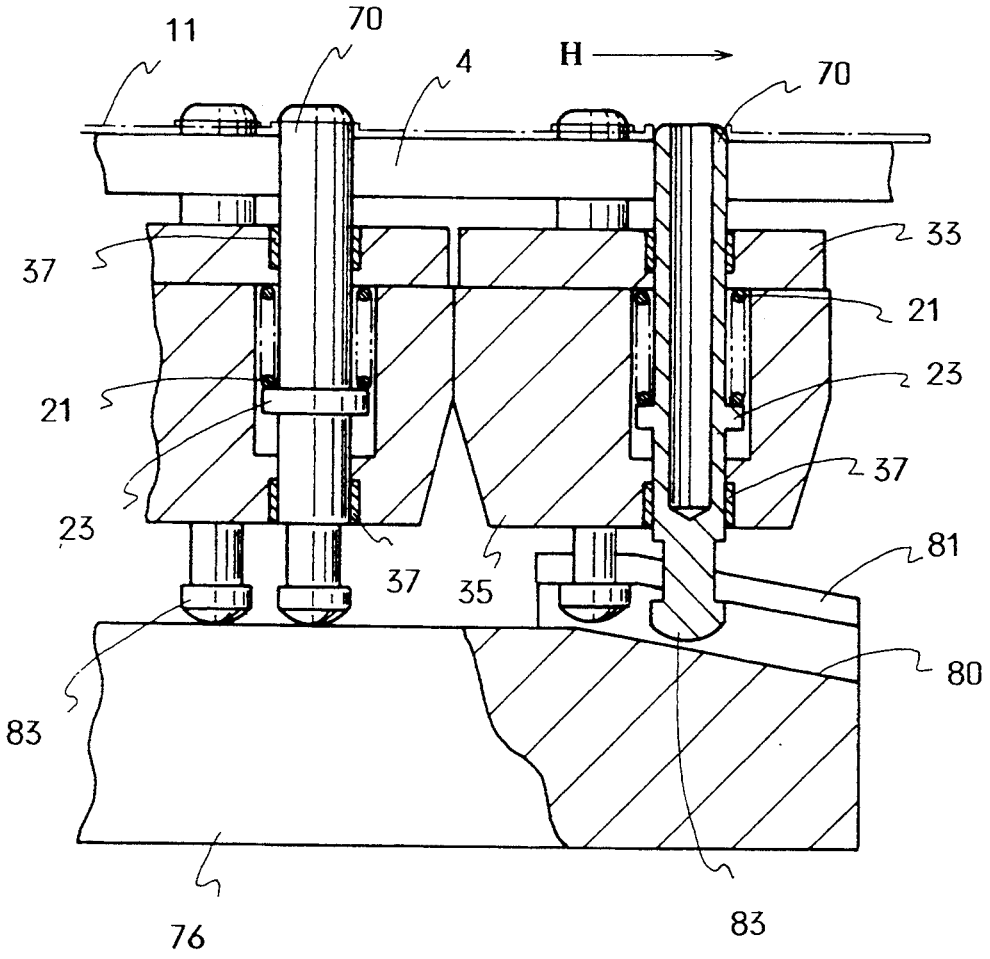
FIG. 4 is a partial sectional view showing another embodiment of a feeding apparatus.

In FIG. 4, the drawing :means consists of flange sections 83 and a contact plate 81. The flange sections 83 are respectively formed at the lower end of each feeding pin 70. The contact plate 83 is provided an the slope section 60 of the plate cam 76 in parallel thereto, and is capable of engaging the flange section 83. With this structure, the feeding pins 70 are drawn downward when the feeding pins 70 slide on the slope section 80, in the direction H. Namely, upper faces of the flange sections 63 engage with a bottom face of the contact plate 81. The contact plate 81 is parallel to the slope section 80 of the plate cam 76, so the feeding pins 70 are drawn downward with the movement of the flange sections 83, which go alongside the contact plate 81, in the direction H. Therefore, the feeding pins 70 can be drawn out from the through-holes 2. When the feeding pins 70 are fully drawn out to release the feeding pins 70 from the through-holes 2, the flange sections 83 are also released from the contact plate Upon being released from the contact plate 81, the feeding pins 70 are returned to initial positions by the elasticity of the spring 21.

By using the plate cam 76 having the drawing means, even if the clearance between the feed pin 70 and the inner face of the through-hole 2 is 0.01 mm–0.1 mm, the slit plates 11 can be fed continuously and stably. The feeding pins 70 are capable of horizontal movement and up-down movement, so the the feeding pins 70 can be fit in and come out from the through-holes 2 linearly. By this linear up-down movement of the feeding pins 70, transformation of the through-holes 2 can be prevented during feedings of the slit plates 11. Furthermore, even if said clearance is very small, the feeding pins 70 can be forced to release from the through-holes 2, transformation of the through-holes 2 can be further prevented during feeding of the slit plates 11.

Next, a manufacturing apparatus for fins of a heat exchanger having the above described feeding apparatus 25 will be explained.

Figure 5:
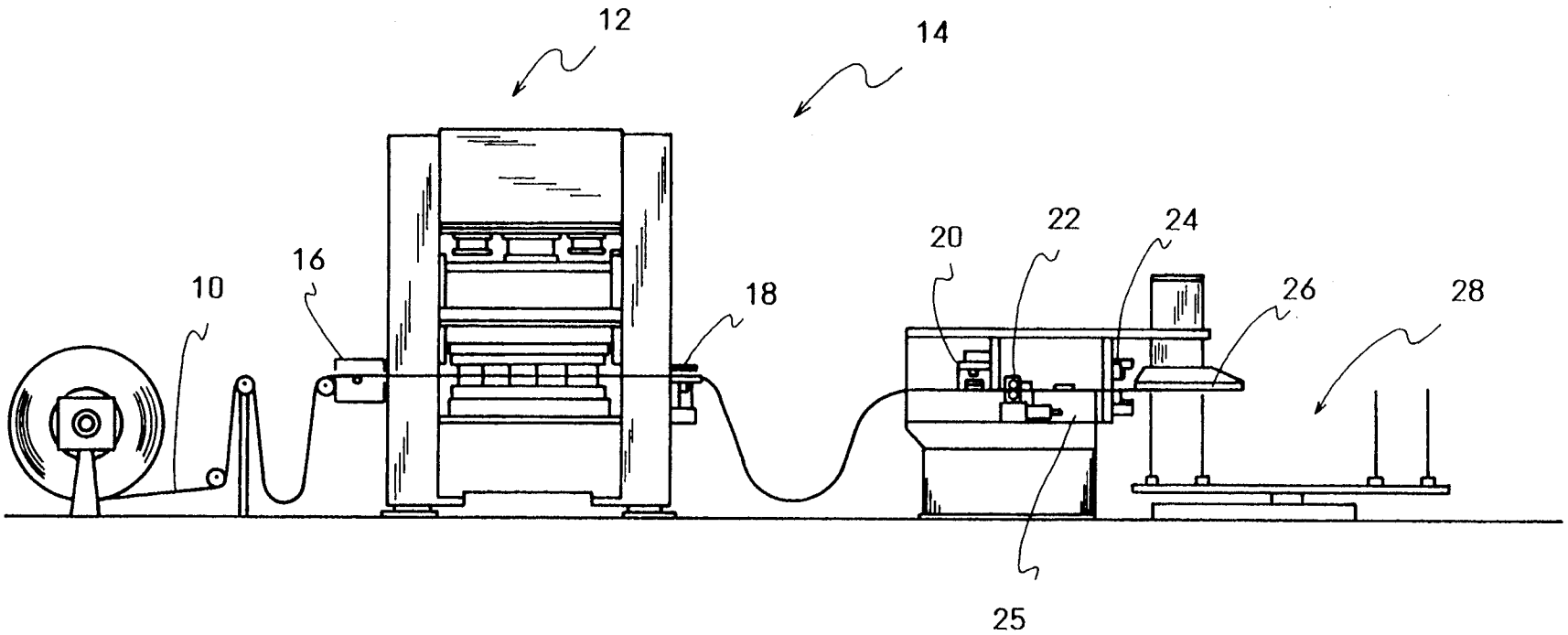
FIG. 5 is an explanation view showing an outline of an embodiment of a manufacturing apparatus for fins of a heat exchanger.

FIG. 5 shows an example of the manufacturing apparatus. In FIG. 5, a metal belting 10, which is wound in a roll is supplied oil for pressworking by an oil supplier 16. After supplying of the oil, the metal belting 10 is fed to a pressing machine 12, which has die sets for said Step-L, -B, -A and -F (see FIG. 12) arranged in the feeding direction of the metal belting 10.

Figure 11A:
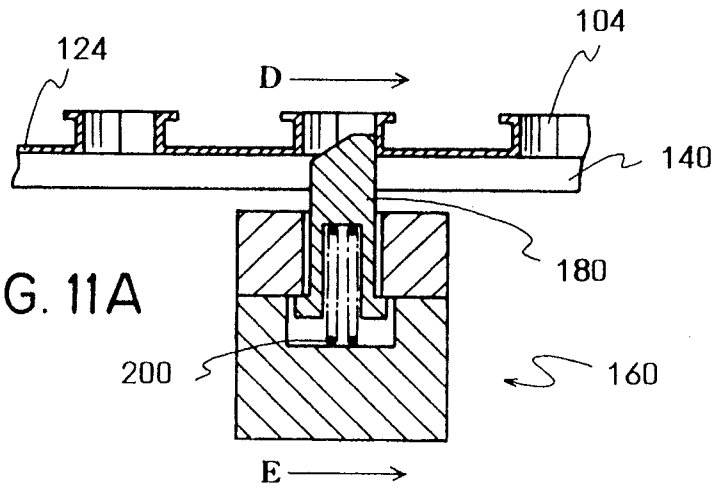
FIGS. 11A and 11B are explanation views showing a conventional feeding apparatus.
Figure 11B:
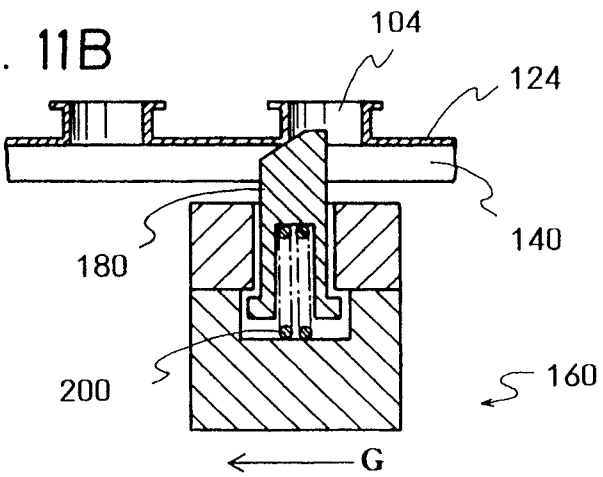

In the pressing machine 12, a plurality of lines of collared through-holes with prescribed height, each of which is lined in a longitudinal direction of the metal be]ting are formed in parallel. The metal belting 10, which is pressworked, is fed from the pressing machine 12 by a feeding apparatus 18, which has feeding pins 180 shown in FIGS. 11A and 11B.

Figure 12A:
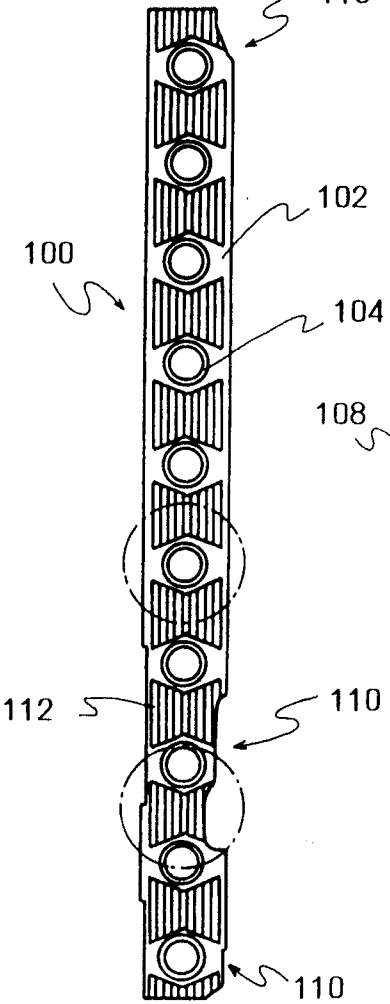
FIGS. 12A, 12B and 12C are explanation views showing fins of a heat exchanger.
Figure 12B:
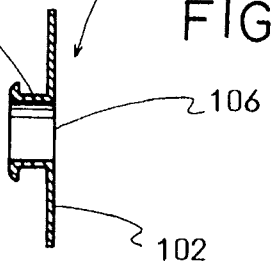
Figure 12C:
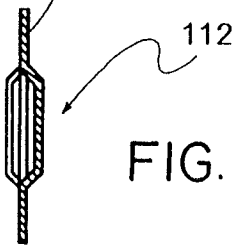
Figure 13:
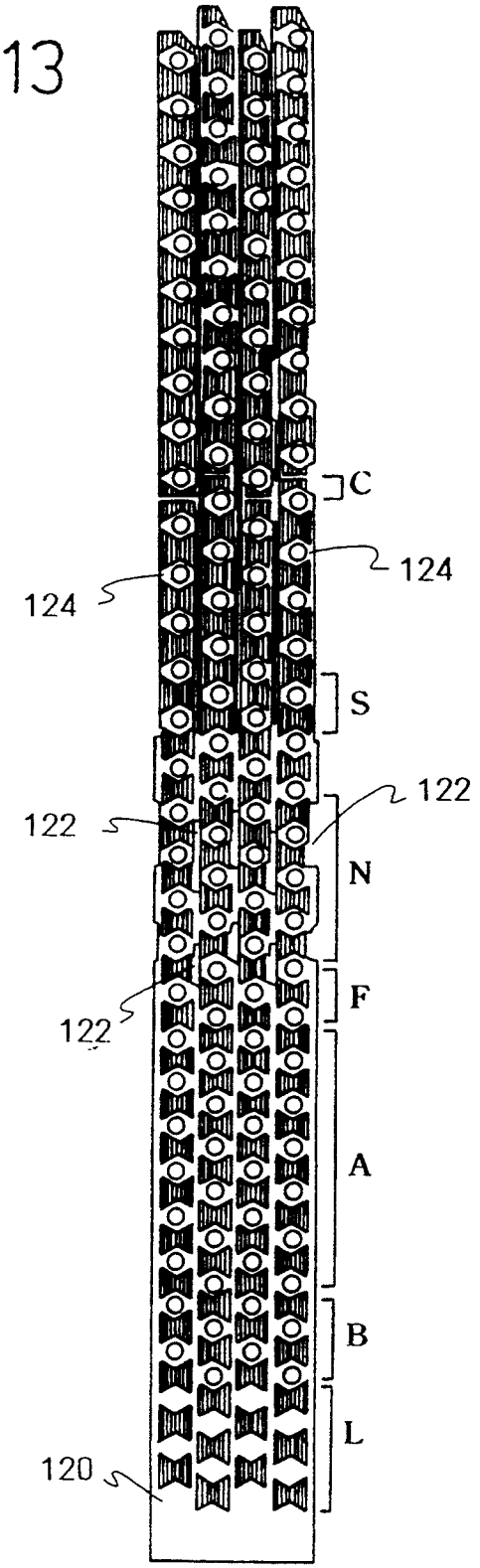
FIG. 13 is an explanation view showing the steps of manufacturing the fins shown in FIG. 12A.

The metal belting 10, which is fed out from the pressing machine 12, is fed to a machining apparatus 14, which is separate away from the pressing machine 12, for said Step-N, -S and -C (see FIG. 12). Therefore, the machining apparatus 14 has a die set for said Step-N, a slitter 22 for said Step-S, the feeding apparatus 25 for feeding the slit plates 11 and a cutter for said Step-C. In the machining apparatus 14, fins, which have a line of collared through-holes in a longitudinal direction and a prescribed length, are stacked in a stacker 28.

Figure 6A:
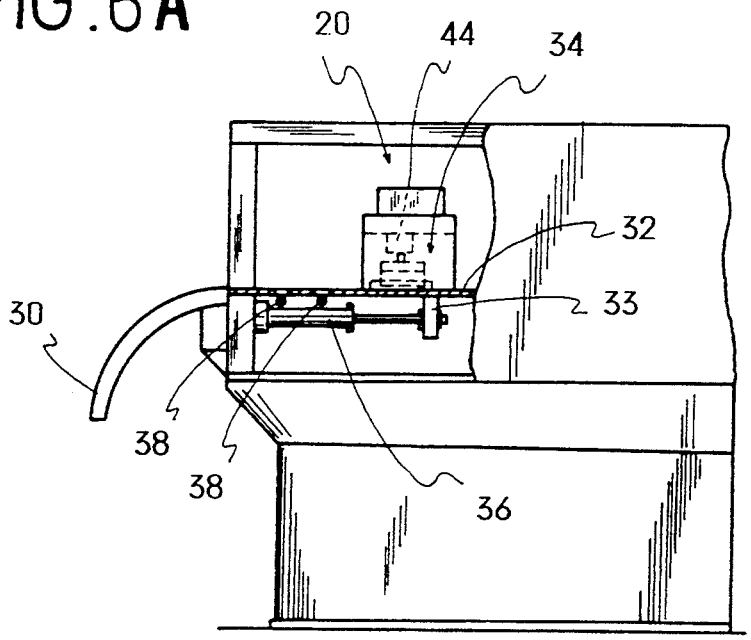
FIG. 6A is a partial side sectional view showing a die set of a machining apparatus shown in FIG. 5.

In a die set unit 20 including the die set for the Step-N, as shown in FIG. 6A, a die set section 34, which includes a plurality of die sets, has a projected section 33 on a bottom face. The die set section 34 is mounted on a mounting plate 32 and the dies and punches are pressed by a ram 44. One end of a rod of a cylinder 36 is connected to the projected section 33. With this structure, the die set section 34 can be moved on the mounting plate 32 by the cylinder 36.

There is provided die lifters 38 beneath the mounting plate 32. The mounting plate 32 has a couple of slits 37 to make the die lifters 38 possible to move up and down. There is provided a table for holding another die set section 42 to be exchanged at one end of the die lifters 38 (see FIG. 6B). The table 40 is moved in the direction M by driving means (not shown), which is provided beneath the table 40.

Figure 7:
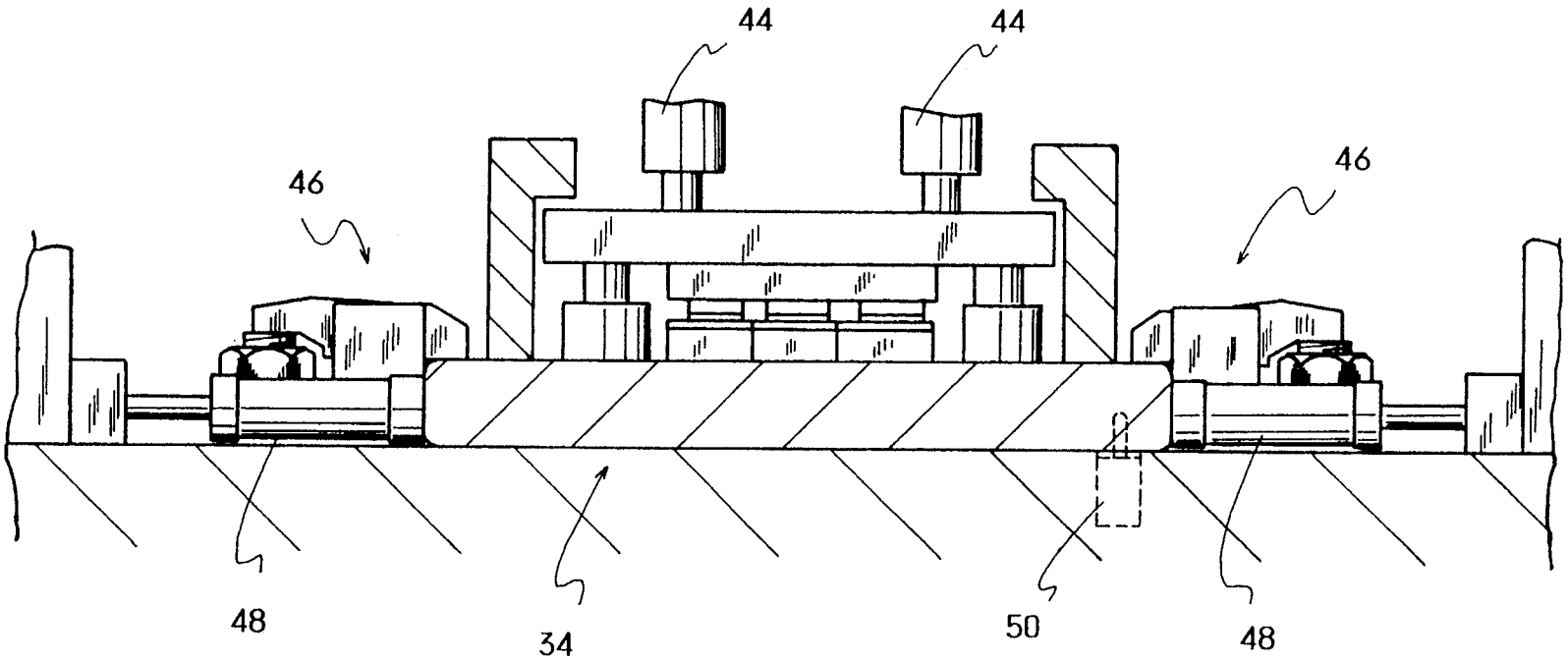
FIG. 7 is an explanation view showing the die set of FIG. 5.

In FIG. 7, the die set section 34 is located by clampers 46 and a holding pin 50. The clampers 46 are capable of sliding on the mounting plate 32 to clamp and unclamp the die set section 34. The state shown in FIG. 7 is a clamping state.

In the die set unit 20, the die set sections can be exchanged automatically. The steps are:

unclamping the die set section 34, which has been in a prescribed position on the mounting plate 32 and has been clamped by the clampers 46, by moving the clampers 46;

moving the die set section 34 to a position above the lifters 38;

lifting the die set section 34 to a position above the mounting plate 32 by the die lifters 38;

transferring the die set section 34 onto the table 40;

moving the table 40 so as to correspond to another die set section 42 to a mounting position of the die lifters 38; and locating the die set section 42 onto the prescribed position on the mounting plate 32.

In the die set unit 20, the metal belting 10 is guided to the die set section 34, by a guide plate 30, to be pressed. After the press, the metal belting 10 is fed to a slitter 22 (see FIG. 8) for slitting each line of the collared through-holes.

Figure 8:
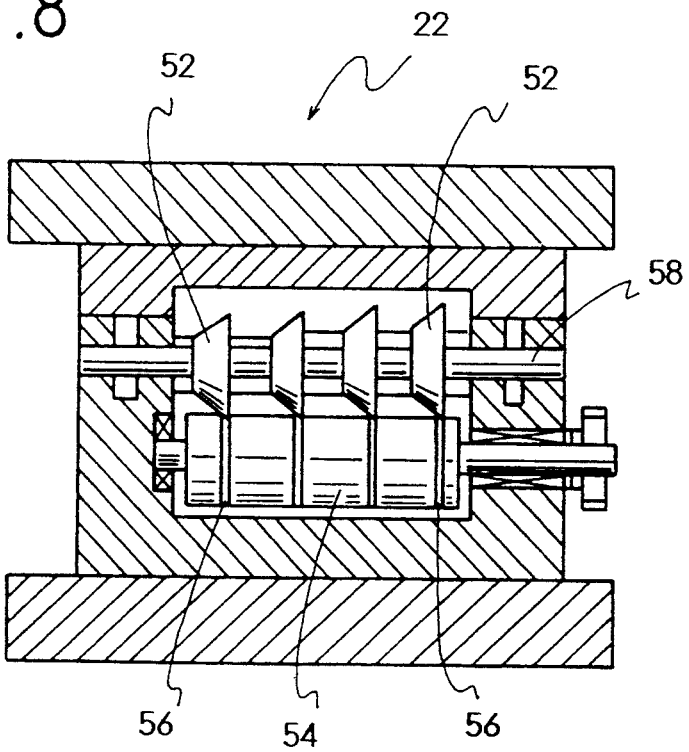
FIG. 8 is a sectional view showing a slitter of the machining apparatus shown in FIG. 5.

As shown in FIG. 8, the slitter 22 has a rotary shaft 58 and cylindrical blades 52, which are fixed on the shaft 58. The blades 52 are capable of engaging with circle grooves 56, which are formed on an outer circumferential face of a cylindrical section 54. When the cylindrical section 54 is rotated, the slitter 22 is also rotated. The pitch between the blades 52 is equal to the width of the slit plates 11.

Figure 9:
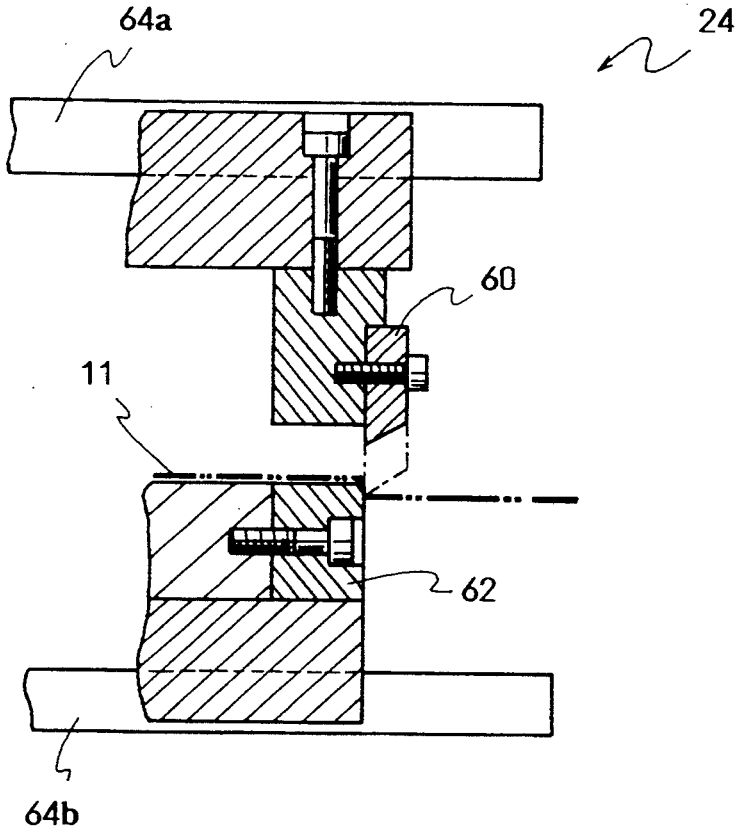
FIG. 9 is a sectional view showing a cutter of the machining apparatus shown in FIG. 5.

The metal belting 10, which has been slitted alongside each line of the collared through-holes, is cut by the cutter 24 to have a prescribed length. The cutter 24, as shown in FIG. 9, has an upper blade 60 and a lower blade 62. The blades 60 and 62 are capable of moving alongside guides **64*a* and 64*b*** for a wide use.

In the manufacturing apparatus for fins, there is provided the feeding apparatus 25 (see FIG. 1) between the slitter 22 (see FIG. 8) and the cutter 24 as shown in FIG. 5.

Using the feeding apparatus 25 shown in FIG. 1, as described above, the driving force of the drive wheel 3 is transmitted to the traveling plates 68, and the traveling plates 68 moves along the guide groove 84. Therefore, the traveling plates 68 are continuously moved when the drive wheel 3 is driven continuously. The traveling plates 68 are intermittently moved when the drive wheel 3 is driven intermittently. Furthermore, while the traveling plates 68 are intermittently moved, if the drive wheel 3 is stopped, the traveling plates 68 stop the movement. At that time, the feeding pins 70 of some traveling plates 68 are still in the through-holes 2 of the slit plates 11, so that the metal belting 10 including the slit plates 11 is held in its position. By holding the position of the metal belting 10, the pressworking in the die set unit 20 and the cutting in the cutter 24 can be executed accurately.

In the feeding apparatus 25, the slit plates 11 can be continuously fed to a prescribed length, and the metal belting 10 and the slit plates 11 can be accurately stopped and located. So even if the slitter 22, which is capable of slitting the metal belting 10 continuously, is used, the action of the feeding apparatus 25 can be adjusted with the die set unit 20, the cutter 24, etc., which are driven intermittently. Furthermore, the feeding apparatus 25 need not have the means for locating, which is provided in the conventional feeding apparatus shown in FIGS. 11A and 11B, so that the size of the machining apparatus 14 can be smaller.

In case of using the feeding apparatus 25 having the drawing means, which is provided to the plate cam 76 (see FIG. 4), if the clearance between the through-holes 2 and the feeding pins 70 is 0.01 mm–0.1 mm, the slit plates 11 can be fed stably, and the slitter 22 is capable of continuously slitting the metal belting 10 stably. The traveling plates 68 can be at a standstill by stopping the rotation of the drive wheel 3, so that the metal belting 10 and the slit plates 11 can be accurately stopped and located, and the pressworking in the die set unit 20 and the cutting the slit plates 11 in the cutter 24 can be executed accurately.

The feeding pins 70 are capable of moving up and down during the horizontal movement. And the feeding pins 70 are capable of linearly moving with respect to the through-holes 2 of the slit plates 11. Therefore, transformation of the through-holes 2 can be prevented during feeding. Even if the clearance between the through-holes 2 and the feeding pins 70 is very small, the feeding pins 70 can be surely drawn from the through-holes 2 by the drawing means, so that the transformation is further prevented, These days, to increase the heat exchangeability of the fins, slits and louvers are formed between the through-holes 2 (see FIG. 12). Even if the slit plates 11 have the slits and the louvers, the upper ends of the feeding pins 70 never contact the bottom faces of the slit plates 11, so that the slit plates 11 can be fed without transforming the slits and the louvers.

In the above described feeding apparatus 25, the drawing means consists of the contact plate 81, which is capable of engaging with the flange sections 83 of the feeding pins 70, provided to the slope section 80 of the plate cam 76. But the drawing means is not limited to the contact plate 81. For example, a magnet, which is provided on the slope section of the plate cam 76, for drawing the feeding pins 70, which are made of a magnetizable material, can be used as the drawing means.

In the above described embodiment, a plurality of the traveling plates 68 are adjacent one another but some of thrum can be spacers. Namely, some spacers, which have no feeding pins, can be aligned among the traveling plates 68. Furthermore, the feeding apparatus 25 can be used for feeding metal beltings, which have holes, besides the metal belting 10 for fins of a heat exchanger.

Figure 6B:
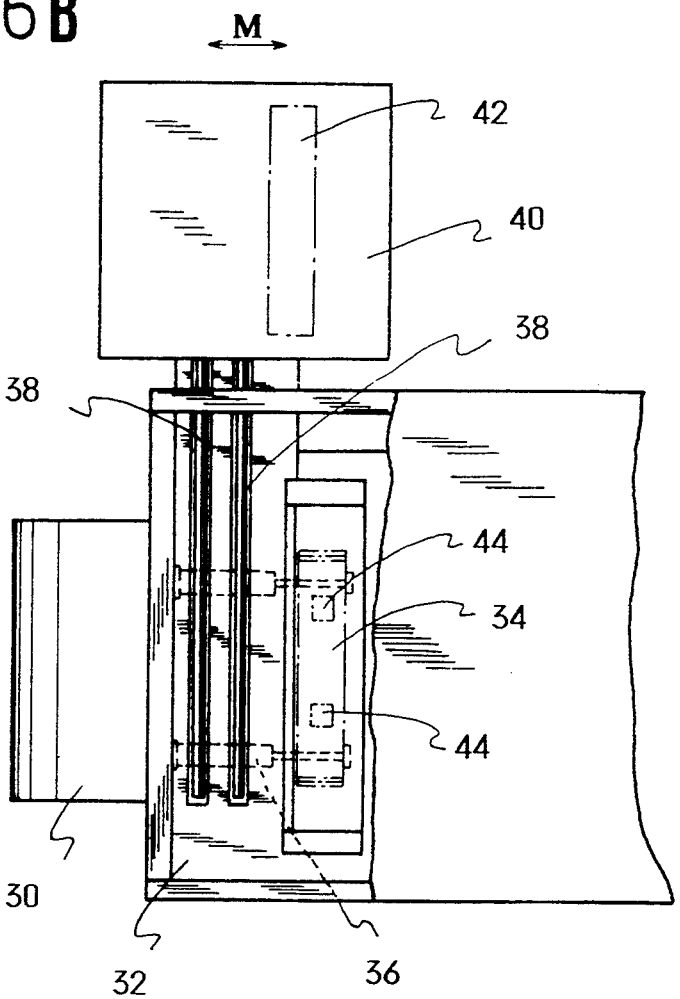
FIG. 6B is a partial plan sectional view showing the die set of the machining apparatus shown in FIG. 5.

In the die set unit 20 shown in FIGS. 6A and 6B, no for adjusting the position of the die set section 34 are provided. The corner-cut section 110 (see FIG. 12) is formed so as to avoid interference between the fin 100 and other members, the positions of the corner-cut sections 110 depends on the position of said other member. In most cases, the positions of the corner-cut sections 110 are slightly deviated in the longitudinal direction of the fin 100.

In the die set unit 20 shown in FIGS. 6A and 6B, the position of the die set section 34 must be manually adjusted, so it is difficult to change the positions of the corner-cut sections 110. On the other hand, in an apparatus shown in FIGS. 10A and 10B, the position of the die set section 34 for the Step-N can be easily adjusted, so that the positions of the corner-cut sections 110 can be easily adjusted.

Figure 10A:
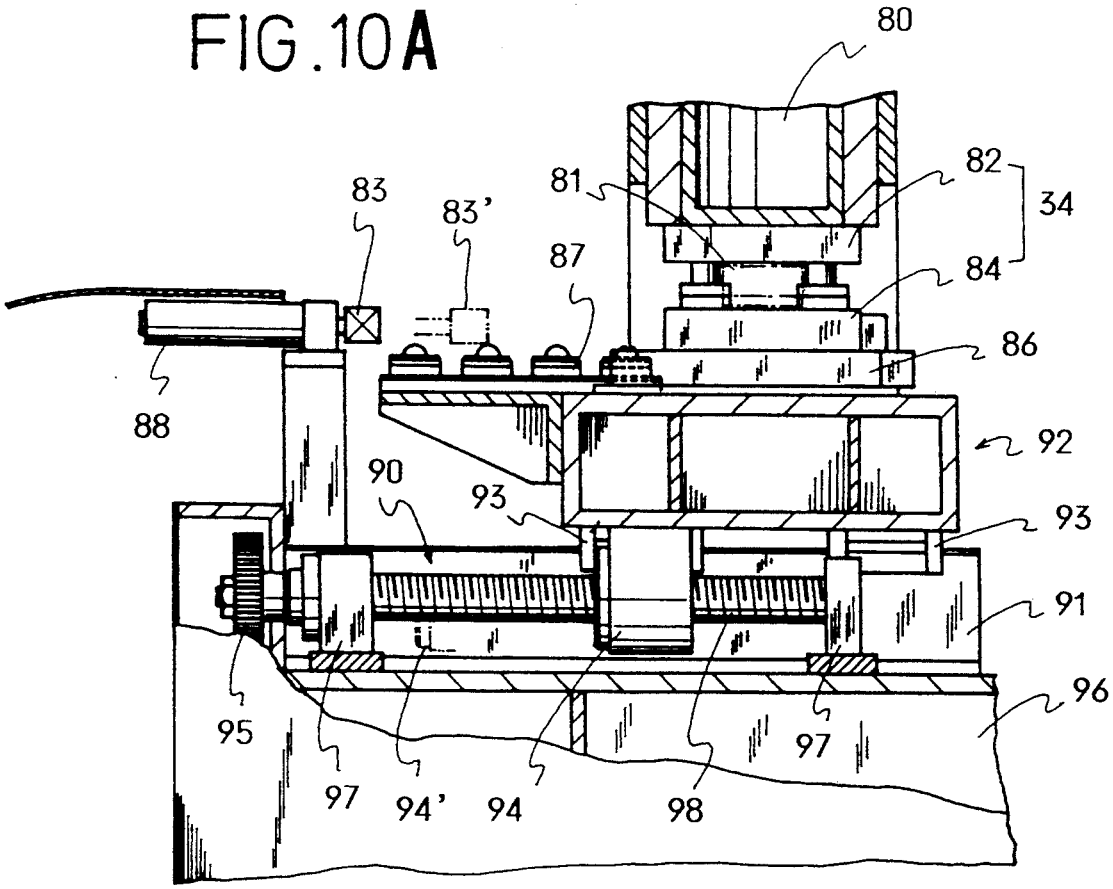
FIGS. 10A and 10B are explanation views showing another embodiment of the die set.

FIG. 10A is a partial sectional view of a die set unit, which is an improved unit of the die set unit shown in FIGS. 6A and 6B. The die set section 34 has a die set 81, which is provided between an upper die set plate 82 and a lower die set plate 84. Pressing force from an oil cylinder (not shown) transmitted to the die set section 34 via a pressing member 80.

The die set plate 84 is mounted on a fixed board 86, which is fixed on a movable board 92, which is driven by a ball screw mechanism 90. The movable board 92 is guided by guide members 93, which are capable of moving alongside a guide plate 91, which is fixed on a base 96. The guide members 93 may be able to surely locate the die set section 34 by clamping the guide plate 91 when the die set section 34 reaches a prescribed position.

The ball screw mechanism 90 has a pair of supporting units 97, which are fixed on the base 96, a screw section 98, which is rotatably supported between the supporting units 97, and a ball unit 94, which is provided between the supporting units 97 and fixed to the movable board 92. The screw 98 is connected to a servo motor (not shown) via a gear 95. Driving the servo motor, the torque is transmitted to the screw section 98 via the gear 95, so that the ball unit 94 and the movable board 92 is moved. Therefore, by adjusting the amount of rotation of the servo motor, the moving length of the movable board 92, or the location of the die set section 34 can be precisely adjusted.

Figure 10B:
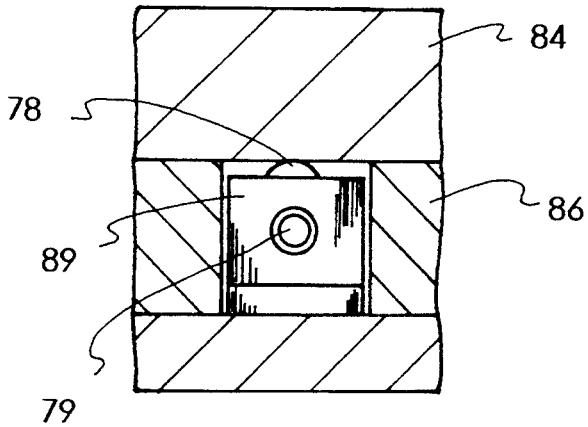

The die set unit shown in FIG. 10A has an electromagnetic holder 83 for exchanging the die set section 34, which is driven to come close to and separate away from the die set section 34 by an air cylinder 88. To easily exchange the die set section 34, there are a plurality of free bearings 87, which bearing balls are rotatably accommodated, on the movable board 92, on the electromagnetic holder 83 side. There are provided a plurality of air-free bearings 69, as shown in FIG. 10B, on the fixed board 86, on which the die set section 34 is mounted. In the air-free bearing 89, compressed air is introduced to an air-port 79, and the compressed air introduced lifts balls 78.

With above described structure, the steps of exchanging the die set section 34 are:

driving the screw section 98 so as to move the ball unit 94 to the position 94';

releasing the oil pressure, which pressed the pressing member 80, from the the oil cylinder;

lifting the balls 78 of the air-free bearing 89 by introducing compressed air so as to move the die set section 34 easily;

moving the electromagnetic holder 83, which is magnetized, to the position 83' by the air cylinder 88 so as to join the electromagnetic holder 83 with the die set section 34; and.

drawing the die set section by the air cylinder 88.

The die set section 34 drawn out is supported on the free bearings 87, so that the die set section 34 can be moved easily.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A feeding apparatus for a metal belting having a plurality of through-holes in a feeding direction, the feeding apparatus comprising:

a basic plate supporting said metal belting, said basic plate having a slit formed in the feeding direction, wherein the through-holes correspond to the slit when said metal belting is supported on said basic plate;

a plurality of traveling plates being provided beneath and in parallel to said basic plate, said traveling plates being movable in the feeding direction of said metal belting, the traveling plates being independently movable relative to one another without a direct interconnection therebetween to thereby avoid play between the traveling plates;

driving means for moving said traveling plates in the feeding direction of said metal belting;

a plurality of feeding pins extending through said traveling plates, wherein lower ends of said feeding pins are projected from bottom faces of said traveling plates;

biasing means for biasing said feeding pins downward; and a plate cam being provided beneath said traveling plates, said plate cam applying force to upwardly move said feeding pins, against said biasing means, in a prescribed range, whereby upper ends of said feeding pins are movable to fit into the through-holes of said metal belting and the feeding pins being movable in the feeding direction with the traveling plates to move said metal belting a prescribed length.

2. The feeding apparatus for a metal belting according to claim 1, further comprising drawing means for drawing said feeding pins, which are inserted into the through-holes of said metal belting, out therefrom, said drawing means being provided at an end, in the feeding direction of said metal belting, of said plate cam.

3. The feeding apparatus for a metal belting, the metal belting having a plurality of through-holes in a feeding direction, the feeding apparatus comprising:

a basic plate supporting said metal belting, said basic plate having a slit formed in the feeding direction, wherein the through-holes correspond to the slit when said metal belting is supported on said basic plate;

a plurality of traveling plates being provided beneath and in parallel to said basic plate, said traveling plates being movable in the feeding direction of said metal belting;

driving means for moving said traveling plates in the feeding direction of said metal belting;

a plurality of feeding pins extending through said traveling plates, wherein lower ends of said feeding pins are projected from bottom faces of said traveling plates;

biasing means for biasing said feeding pins downward;

a plate cam being provided beneath said traveling plates, said plate cam applying force to upwardly move said feeding pins, against said biasing means, in a prescribed range, whereby upper ends of said feeding pins are fitted into the through-holes of said metal belting and move said metal belting to a prescribed length in the feeding direction;

drawing means for drawing said feeding pins out of the through-holes of said metal belting, said drawing means being provided at an end in the feeding direction of said plate cam, the drawing means comprising;

a slope section for gradually reducing the force, which is applied to upwardly move said feeding pins against said biasing means, said slope section being provided at an end, in the feeding direction of said feeding pins, of said plate cam; and a contact plate being movable into contact with flange sections, which are formed at lower end section of each feeding pin, so as to force the flange sections downward, said contact plate being provided in parallel to said slope section.

4. The feeding apparatus for a metal belting according to claim 1 wherein, a longitudinal sectional shape of said plate cam is a trapezoid.

5. The feeding apparatus for a metal belting according to claim 1, further comprising a guide plate being provided for said basic plate and in parallel to the feeding direction of said metal belting, said guide plate having a looped guide groove, wherein said traveling plates are provided alongside the guide groove.

6. The feeding apparatus for a metal belting according to claim 5, further comprising a guide section having a guide roller rollable on an inner face of the looped guide groove, said guide section being provided on said traveling plate, which is on the guide groove side.

7. The feeding apparatus for a metal belting according to claim 6 wherein, said guide section has a transmitting section for transmitting driving force from said driving means.

8. A manufacturing apparatus for fins of a heat exchanger comprising:

a die set for forming a plurality of parallel lines of collared through-holes, each of which are formed in a longitudinal direction of a metal belting, in the transverse direction thereof;

a slitter for continuously slitting between adjacent lines of the collared through-holes in the longitudinal direction of said metal belting so as to make slit plates, the slit plates include a line of the collared through-holes; a cutter for cutting said slit plates to a prescribed length; and a feeding apparatus having:

a plurality of traveling plates movable in the feeding direction, the travelling plates being independently movable without a direct interconnection therebetween to thereby avoid play between the traveling plates;

a plurality of feeding pins being provided between said slitter and said cutter, said feeding pins being received in the traveling plates and being movable therewith in the feeding direction of said slit plates, one end of the feeding pins fitting into the collared through-holes of each slit plate;

biasing means being provided for each feeding pin, said biasing means biasing said feeding pins to separate from the collared through-holes;

a plate cam having a cam face extending in the feeding direction of said slit plates, the cam face biasing said feeding pins against said biasing means, whereby said feeding pins are fitted into the collared trough-holes and are movable toward said cutter by a prescribed length; and driving means for moving said feeding pins in the feeding direction.

9. The manufacturing apparatus for fins of a heat exchanger according to claim 8 wherein, said feeding apparatus further comprises:

a basic plate supporting said slit plate, which has a plurality of through-holes in a feeding direction, said basic plate having a slit formed in the feeding direction, wherein the through-holes correspond to the slit when said slit plate is supported on said basic plate;

the plurality of traveling plates being provided beneath and in parallel to said basic plate;

the driving means moving said traveling plates in the feeding direction of said slit plate;

the plurality of feeding pins extending through said traveling plates, wherein lower ends of said feeding pins are projected from bottom faces of said traveling plates;

the biasing means biasing said feeding pins downward; and the plate cam being provided beneath said traveling plates, said plate cam applying force t upwardly move said feeding pins, against said biasing means, in a prescribed range, whereby upper ends of said feeding pins are movable to fit into the through-holes of said slit plate and moving said metal belting the prescriber length.

10. The manufacturing apparatus for fins of a heat exchanger according to claim 8, further comprising drawing means for drawing said feeding pins, which are inserted into said slit plate, out therefrom, said drawing means being provided at an end, in the feeding direction of said slit plate, of said pale cam.

11. A manufacturing apparatus for fins of a heat exchanger comprising:

a die set for forming a plurality of parallel lines of collared through-holes, each of which are formed in a longitudinal direction of a metal belting, in the transverse direction thereof;

a slitter for continuously slitting between adjacent lines of the collared through-holes in the longitudinal direction of said metal belting so as to make slit plates, the slit plates include a line of the collared through-holes;

a cutter for cutting said slit plates to a prescribed length;

a feeding apparatus having:

a plurality of feeding pins being provided between said slitter and said cutter, said feeding pins being movable in the feeding direction of said slit plates, one end of the feeding pins fitting into the collared through-holes of each slit plate;

biasing means being provided for each feeding pin, said biasing means biasing said feeding pins to separate from the collared through-holes;

a plate cam having a cam face extending in the feeding direction of said slit plates, the cam face biasing said feeding pins against said biasing means, whereby said feeding pins are fitted into the collared through-holes and are movable toward said cutter by a prescribed length;

driving mans for moving said feeding pins in the feeding direction;

drawing means for drawing said feeding pins out of said slit plate, said drawing means being provided at an end in the feeding direction of said plate cam, the drawing means comprising;

a slope section for gradually reducing the force, which is applied to upwardly move said feeding pins against said biasing means, said slope section being provided at an end, in the feeding direction of said feeding pins, of said pale cam; and a contact plate being movable into contact with flange sections, which are formed at lower end section of each feeding pin, so as to force the flange sections downward, said contact plate being provided in parallel to said slope section.

12. The manufacturing apparatus for fins of a heat exchanger according to claim 8 wherein, a longitudinal sectional shape of said plate cam is a trapezoid.

13. The manufacturing apparatus for fins of a heat exchanger according to claim 9, further comprising a guide plate being provided for said basic plate and in parallel to the feeding direction of said slit plate, said guide plate having a looped guide groove, wherein said traveling plates are provided alongside the guide groove.

14. The manufacturing apparatus for fins of a heat exchanger according to claim 13, further comprising a guide section having a guide roller rollable on an inner face of the looped guide groove, said guide section being provided on said traveling plate, which is on the guide groove side.

15. The manufacturing apparatus for fins of a heat exchanger according to claim 14 wherein, said guide section has a transmitting section for transmitting driving force from said driving means.

16. The manufacturing apparatus for fins of a heat exchanger according to claim 8, further comprising an intermediate die set for boring through-holes between the lines of the collared through-holes of said metal belting, said intermediate die set being provided between said die set for forming lines of the collared through-holes and said feeding apparatus.

17. The manufacturing apparatus for fins of a heat exchanger according to claim 8 wherein, said slitter is provided adjacent to said intermediated die set.

18. The manufacturing apparatus for fins of a heat exchanger according to claim 16, further comprising adjusting means for adjusting a position of said intermediate die set.

19. The manufacturing apparatus for fins of a heat exchanger according to claim 18 wherein, said adjusting means is a ball bearing screw mechanism.

20. The manufacturing apparatus for fins of a heat exchanger according to claim 16, further comprising an automatic exchanger for exchanging said intermediate die set.

* * * * *